US005543765A

United States Patent [19]

Cachier

[11] Patent Number: 5,543,765

[45] Date of Patent: Aug. 6, 1996

[54] INTEGRATED ELECTRONIC ELEMENTS WITH VARIABLE ELECTRICAL CHARACTERISTICS, ESPECIALLY FOR MICROWAVE FREQUENCIES

[75] Inventor: Gérard Cachier, Bures S/Yvette, France

[73] Assignee: Thomson - C S F, Paris, France

[21] Appl. No.: 230,239

[22] Filed: Apr. 20, 1994

[30] Foreign Application Priority Data

Apr. 20, 1993 [FR] France ..... 93 04628

[51] Int. Cl.[6] ..... H01P 5/04; H01P 1/18

[52] U.S. Cl. ..... 333/246; 333/263; 333/159; 333/161

[58] Field of Search ..... 33/159, 161, 164, 33/156, 101, 105, 235, 245, 246, 263

[56] References Cited

U.S. PATENT DOCUMENTS 3,166,723 1/1965 Bock et al. ..... 333/111
5,115,217 5/1992 McGrath et al. ..... 333/263 X
5,164,688 11/1992 Larson ..... 333/263 X

FOREIGN PATENT DOCUMENTS 0517232 12/1992 European Pat. Off. .
0516166 12/1992 European Pat. Off. .

OTHER PUBLICATIONS

Microwave Journal, V. 13, No. 5, May 1970, pp. 17E–20E, S. Cornbleet (ed.).

*Primary Examiner*—Benny Lee
*Attorney, Agent, or Firm*—Oblon, Spivak, McClelland, Maier & Neustadt, P.C.

[57] ABSTRACT

Disclosed are electronic elements with variable electrical characteristics, each element including at least one micro-cavity in which there shifts, with a limited clearance or range of play, at least one moving element made of an insulator material that is at least partially covered with electrically conductive material, and that works together with at least one microwave circuit of the substrate, and means creating an electrical field to shift the moving element.

20 Claims, 4 Drawing Sheets

INTEGRATED ELECTRONIC ELEMENTS WITH VARIABLE ELECTRICAL CHARACTERISTICS, ESPECIALLY FOR MICROWAVE FREQUENCIES

BACKGROUND OF THE INVENTION

1. Field of the Invention

The present invention relates to integrated electronic elements with variable electrical characteristics, especially for microwave frequencies.

Various microwave components have been created over the past few decades: diodes, then microwave transistors, notably made of GaAs, and then monolithic microwave integrated circuits (MMICs).

2. Description of the Prior Art

However, the technologies of miniaturization have not yet properly resolved the problems of the manufacture of certain integrated circuit components that could be used in large numbers and at low cost on very small surfaces, especially in electronic scanning antennas such as those used in "anti-fading" communications devices, communications with moving bodies (whether civilian or military) and in civilian radars (radars for landing systems, anticollision radars etc.). The components used in the phase-shifting circuits of these antennas may include ferrite circuits which are far too bulky or PIN diodes which show high losses and a high level of static power consumption. Certain active antennas use GaAs integrated circuits that are far too costly for many civilian applications and for mass production.

An object of the present invention relates to integrated electronic elements with variable electrical characteristics, especially for microwave frequencies, these characteristics being easily controllable without any need for bulky control elements while at the same time consuming a negligible amount of electrical power, these elements having negligible losses and working efficiently in a wide range of frequencies while being practically insensitive to radiation, easy and inexpensive to manufacture and compatible with the integration of microwave microstrip lines, especially on silicon-based insulator substrates, and being compatible with industrial techniques for the manufacture of digital circuits (especially CMOS circuits). The variable electrical characteristics are, in particular: the capacitance, the impedance, the length of the electrical path length, or the layout of this path length.

SUMMARY OF THE INVENTION

The electronic elements according to the invention, of the type using integrated microelectronics technology, made by the deposition or formation of different layers on a substrate, each including at least one microcavity in which there shifts, with a limited clearance or range of play, at least one moving element made of an electrically conductive material or of an insulator material that is at least partially covered with electrically conductive material, and that works together with at least one microwave circuit of the substrate, and an electrical device for the actuation of the moving element.

According to a first embodiment of the invention, the moving element is a flexible microbeam connected by at least one of its ends to a wall of this microcavity.

According to a second embodiment, the moving element shifts freely in the microcavity which is at least partially covered with an element that prevents the moving element from coming out of the microcavity.

BRIEF DESCRIPTION OF THE DRAWINGS

The present invention will be understood more clearly from the following detailed description of several embodiments, taken as non-restrictive examples and illustrated by the appended drawings, of which.

MORE DETAILED DESCRIPTION

The invention is described herein below with reference to a electronic scanning microwave antenna, but it is understood that it is not restricted to such an application and that it can be implemented in many other microwave applications.

Figure 1:
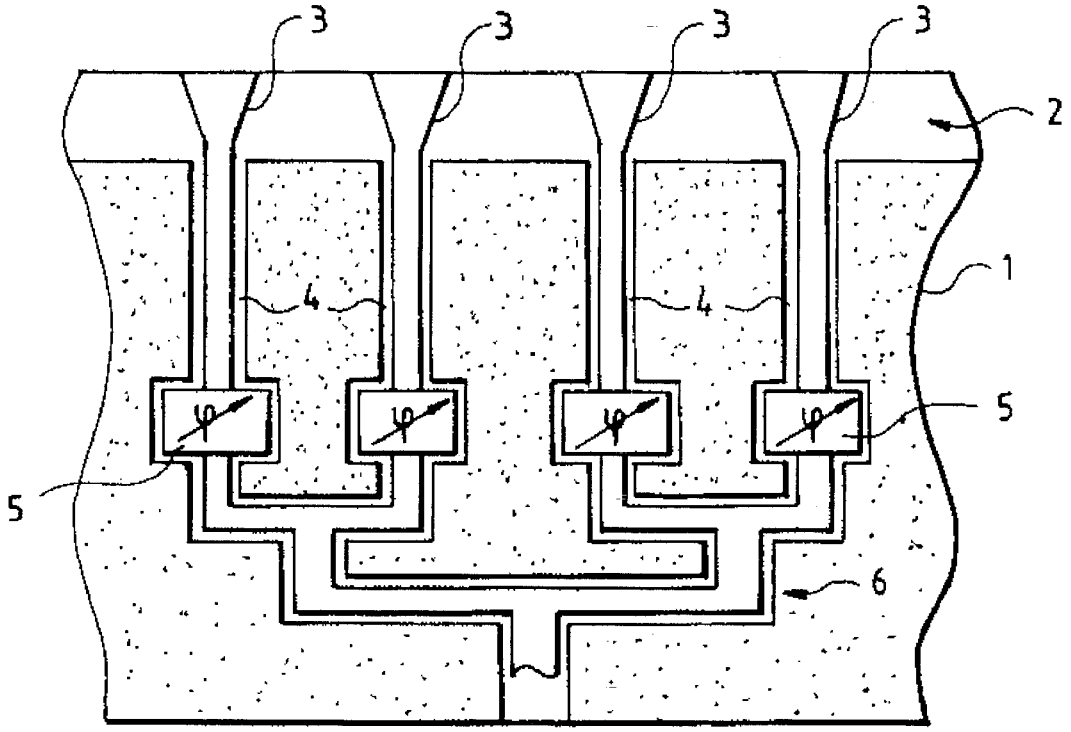
FIGS. 1 and 2 are partial plane views of two embodiments of an array of scanning microwave antennas comprising variable phase-shifters according to the invention.

FIG. 1 shows a substrate 1 on which an array 2 of antennas which are, for example, printed antennas as shown in the drawing, have been formed by standard thin-film deposition and appropriate etching techniques. Each radiating element 3 of this network is connected by a line 4 to a variable phase-shifter 5, the lines 4 being preferably parallel to one another. The different phase-shifters 5 are powered by means of candelabra-shaped corporate feed distribution lines 6 and are described in detail here below.

Figure 2:
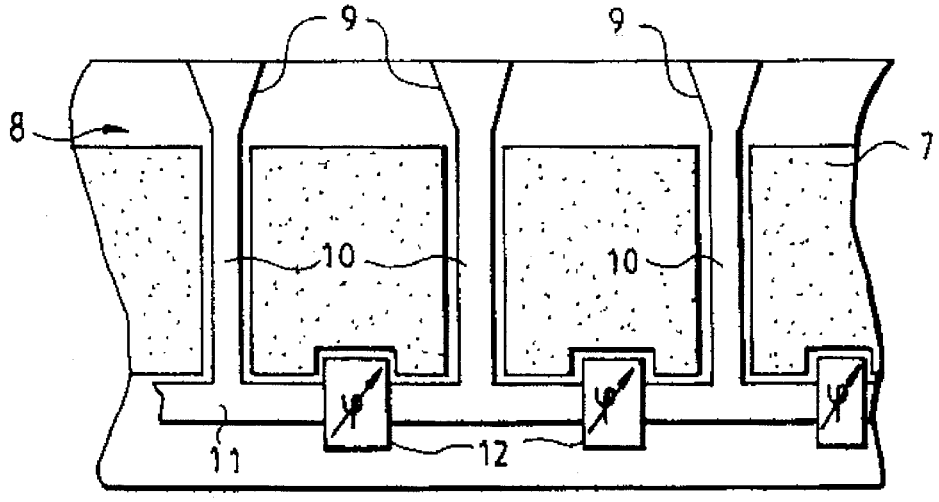

FIG. 2 shows a variant of the circuit of figure 1. An antenna array 8 is formed, in the same way as in the case of FIG. 1, on a substrate 7. Each radiating element 9 of this array is supplied by a line 10, the lines 10 being preferably parallel to one another. The different lines 10 are connected to a line 11 which is preferably perpendicular to them. A phase-shifter 12, made in the same way as the phase-shifters 5, is inserted into the line 11, in between adjacent bases of successive lines 10. A cascaded arrangement of the phase-shifters 12 such as this is made possible by the fact that these phase-shifters have negligible losses as shall be seen here below.

The invention is described here below with reference, in each case, to a single element with variable electrical characteristics, but it is clear that, in reality, a large number of such elements, having identical or different functions, can be grouped together on one and the same substrate and that these elements can be associated on one and the same substrate with elements having different controls (for example elements controlled by electrical or magnetic fields or by bimetallic strip effect) described here below.

Figure 3:
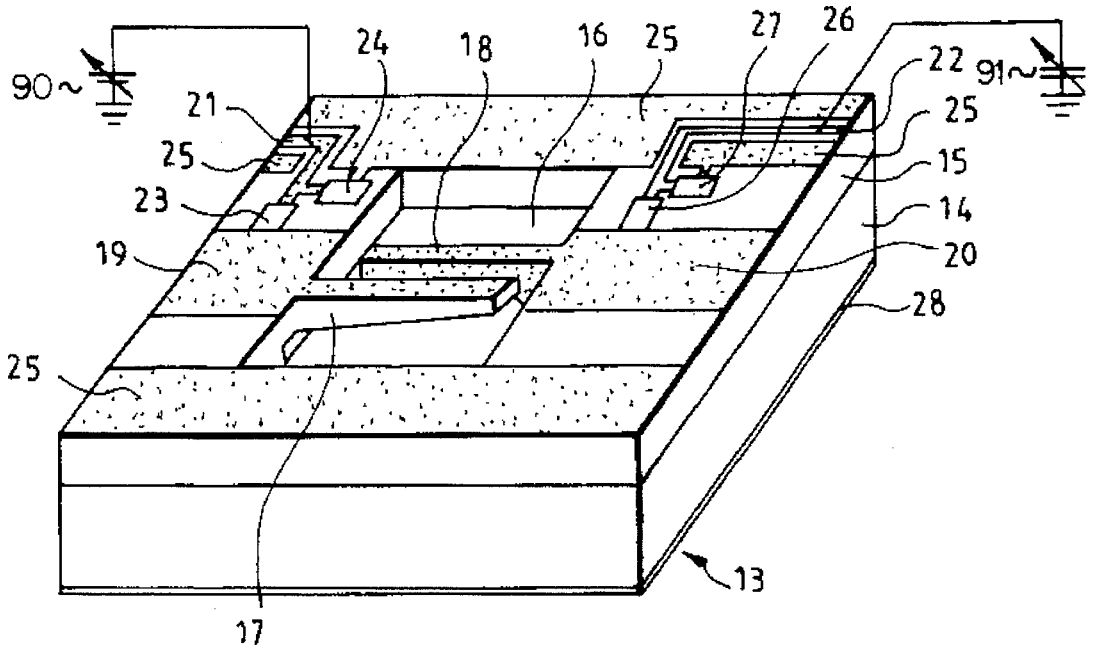
FIG. 3 is a view in perspective of a variable capacitance element according to the invention.

FIG. 3 shows a schematic view of an element 13 with variable capacitance. The element 13 is formed on a preferably monocrystalline substrate 14 made of Si, GaAs or quartz. At least one layer 15, made of a preferably insulating material, is formed on the substrate 14. A substantially parallelepiped shaped cavity 16 is formed in the layer 15 by anisotropic machining while, at the same time, two parallel beams 17, 18 are left in an overhanging position therein.

Naturally, according to a standard technique, there is provision for a barrier layer (not shown) that enables the depth of the cavity 16 to be defined with precision (as in all the embodiments described here below). The shape and dimensions of the beams and the choice of the material (of the layer 15) constituting them are such that these beams can bend without breaking. These beams 17, 18 are connected solely to opposite lateral sides of the cavity 16, and their upper faces are coplanar with the upper face of the layer 15. The beams 17, 18 have, for example, a rectangular section. They are metallized at least on their upper faces and, as the case may be, on their faces that are opposite to each other. This metallization may be done by any appropriate method of deposition. The metallization of the upper face of each beam 17, 18 is formed in continuity with a metallized band (19, 20 respectively) which is itself formed on the upper face of the layer 15. The metallized bands 19, 20 are connected to circuits that are not shown and are formed on the same substrate requiring a variable capacitance and, as the case may be, to other similar variable capacitance elements in parallel with the element 13 (in order to increase the dynamic range of the variation in capacitance). Conductive bands 21, 22 are also deposited on the layer 15. The band 21 is connected by a resistor 23 to the band 19 and by a decoupling capacitor 24 to a conductive layer 25 which is also deposited on the layer 15 and forms a ground. Similarly, the band 22 is connected by a resistor 26 to the band 20 and by a decoupling capacitor 27 to the layer 25. The bands 21 and 22 are connected to a DC control voltage source (90,91). Naturally, the resistors 23, 26 and the capacitors 24, 27 as well as the layer 25 are formed by any appropriate method during the process of the manufacture of the element 13. The layer 25 extends on either side of the cavity 16 so as to constitute an efficient ground with respect to elements working with microwaves (especially the conductors 19, 20 and the metallizations of the beams 17, 18). Advantageously, a metal layer 28 which too acts as a ground is formed on the lower face of the substrate 14.

When a DC control voltage is applied to the bands 21, 22, the electrical field thus created between the mutually opposite faces 17, 18 forces them to get closer to each other or move away from each other depending on the direction of this field, i.e. depending on the polarities of the voltages applied to the bands 21, 22, it being understood that these voltages are high enough to cause the beams 17, 18 to bend. Thus, depending on the value of the voltage applied to the bands 21, 22, a variation is brought about in the distance between the beams 17 and 18 and hence in the capacitance of the capacitor whose electrodes are essentially constituted by the metallizations of the mutually opposing faces of the beams 17, 18.

Figure 4:
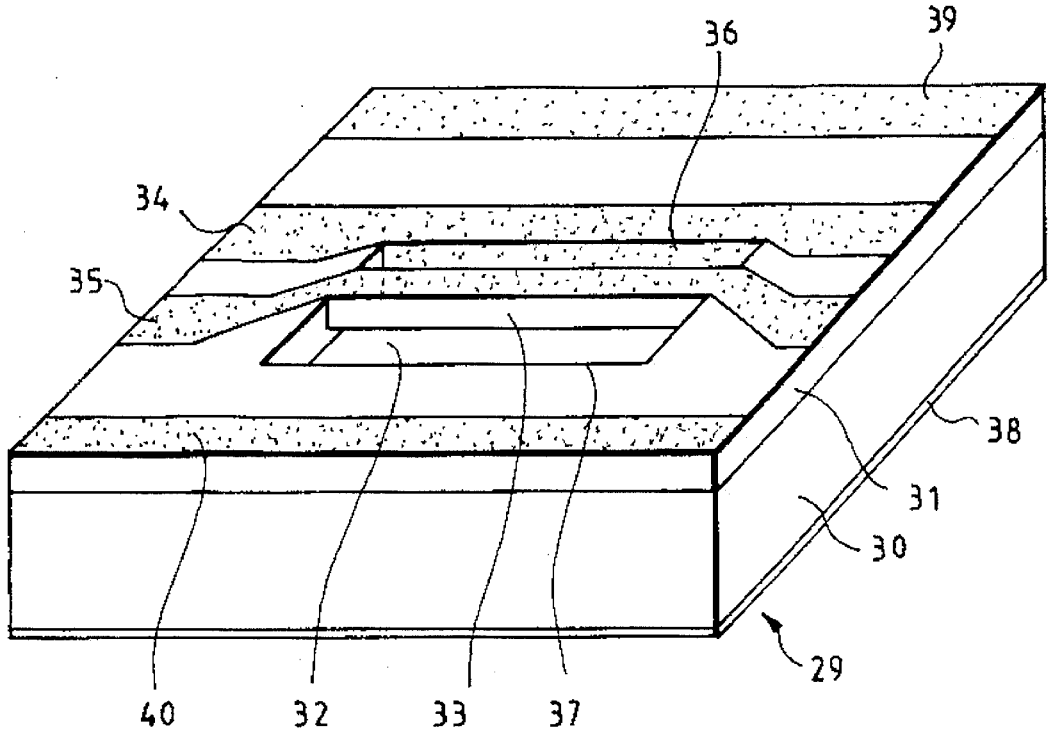
FIG. 4 is a view in perspective of a line element with variable electrical length according to the invention.

FIG. 4 shows a line element 29 whose electrical path length is made to vary by causing local variations in the distributed capacitance.

The element 29 is formed on a substrate 30 on which there is deposited a layer 31 of insulator material. A microcavity 32 is etched in the layer 31, while leaving therein a microbeam 33 that is substantially parallel to a large side of the microcavity. The upper face of the beam 33 is coplanar with the upper face of the layer 31 while its lower face is at a distance from the bottom of the microcavity.

Two bands 34, 35 of conductive material are deposited on the upper face of the layer 31. These two bands 34, 35 are parallel to each other, except in the zone of the cavity 32 where they approach each other. The bands 34, 35 are formed so as to be parallel to the large sides of the cavity 32 outside the zone in which this cavity is located (this zone is slightly greater than the aperture of the cavity). The band 34 narrows down slightly in the region of the cavity, and its narrowed part stretches along the large side 36 of the cavity 32. The band 35 stretches, outside the region of the cavity 32, approximately in the extension of the other large side 37 of the cavity 32, and in the region of the cavity, it approaches the band 34 and passes over the upper face of the beam 33° Advantageously, the mutually opposite lateral faces of the beam 33 and of the cavity 32 are metallized, their metallization being electrically connected respectively to the band 35 and to the band 36, in order to obtain an increase locally, in the region of the cavity, of the facing surfaces between the bands 35 and 34. This increasing of the surfaces enables the creation, between the mutually opposite faces, of an electrical field that is sufficient to make the beam 33 bend and to create a capacitance, between the conductive bands 34, 35 in the region of the cavity 32, that varies as a function of the lateral bending of the beam 33, i.e. as a function of the electrical field between these mutually opposite faces. This electrical field can be created in the same way as for the device 13 of FIG. 3, that is (in a manner that is not shown) by means of conductive bands that apply a DC control voltage between the bands 34 and 35, each time through a resistor and a decoupling capacitor. A metal ground 38 is advantageously formed on the lower face of the substrate 30. Metallizations 39, 40 are advantageously made on the upper face of the layer 31, on either side of the line formed by the bands 34, 35.

Figure 5:
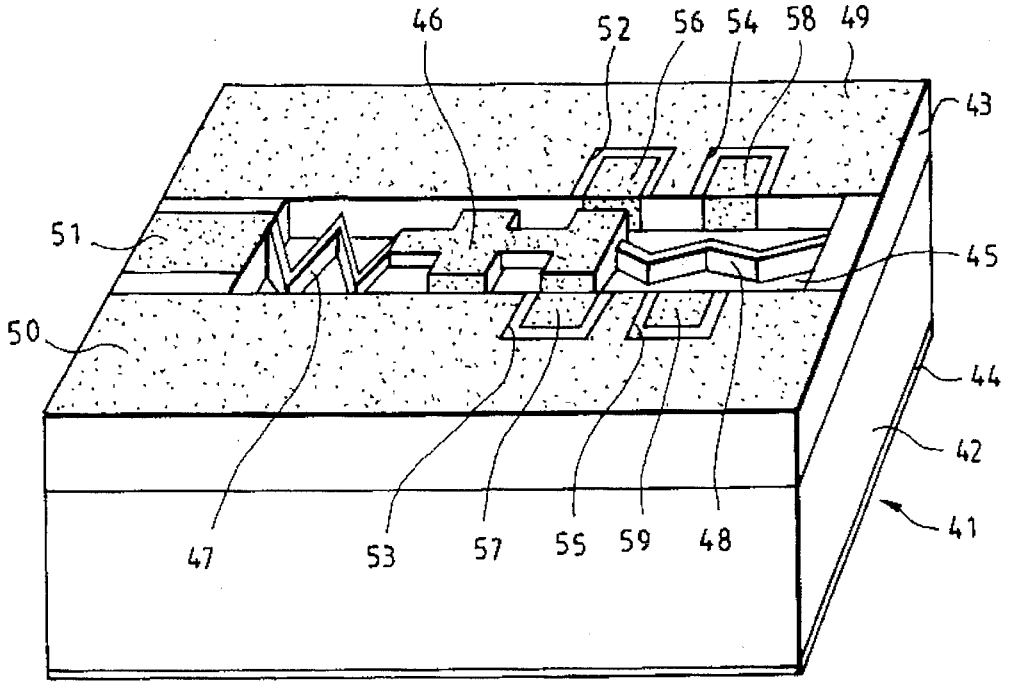
FIG. 5 is a view in perspective of a stub with variable electrical length according to the invention.

FIG. 5 shows an embodiment of a moving stub type element 41. As in the examples described here above, the element 41 is formed on a substrate 42 coated on its upper face with an insulator layer 43 and on its lower face with a metal layer 44 forming a ground. A substantially parallelepiped shaped microcavity 45 is formed in the layer 43 while at the same time a moving element is left therein, this moving element having the shape of two "T"s placed one on top of the other for example. This element is suspended at a short distance above the bottom of the cavity 45 by means of flexible arms 47,48 connecting the longitudinal ends of the element 46 to the lateral small sides of the cavity 45. These flexible arms 47, 48 have, for example, a zigzag shape and constitute small springs. According to a variant (not shown), these arms 47, 48 have a meandering shape. Naturally, these springs are not indispensable, and it is possible to leave the element 46 in a floating state by covering the cavity 45 with an insulating layer that prevents the element 46 from coming out of the cavity while leaving it free in its movements. When the element 46 is at rest (i.e. when it is not subjected to any field), it is located for example approximately at the center of the cavity On the upper face of the element 46, there is deposited a metal layer forming a stub whose length, in the longitudinal direction, is practically equal to a sub-multiple of the wavelength used. The lateral faces of the horizontal arms of the "T"s are advantageously metallized. On each side of the cavity 45, a conductive band 49, 50 respectively is deposited on the upper face of the layer 43.

A conductive band 51, deposited on the layer 43, between the bands 49, 50 ends in a small side of the cavity 45 and forms the end of a microwave line to which there is coupled the moving stub 46 which, depending on its position in the cavity 45, brings a variable impedance to the end of the line 51. In order to shift the stub 46, rectangular facing slots, respectively 52, 53 and 54, 55 are made in the bands 49 and 50, at the edge of the cavity 45. In these slots, conductive pads are formed. These conductive pads are insulated from the bands 49, 50 and are respectively referenced 56, 57, 58, 59. Advantageously, these pads are extended on the corresponding lateral faces of the cavity 45. These different pads are connected (in a manner not shown) for example by resistors or diodes, and by decoupling capacitors, to lines that are themselves connected, through an inverter, to a source of DC voltage. Depending on the position of this inverter, the voltage is applied either to the pair of pads 52, 53 or to the pair 54, 55. This creates an electrical field between the pads of one of these pairs and draws the moving element 46 towards this pair. As an alternative, no slots 52 to 55 are made but the pads 56 to 59 are deposited on an additional insulating layer covering at least the bands 49, 50.

Figure 6:
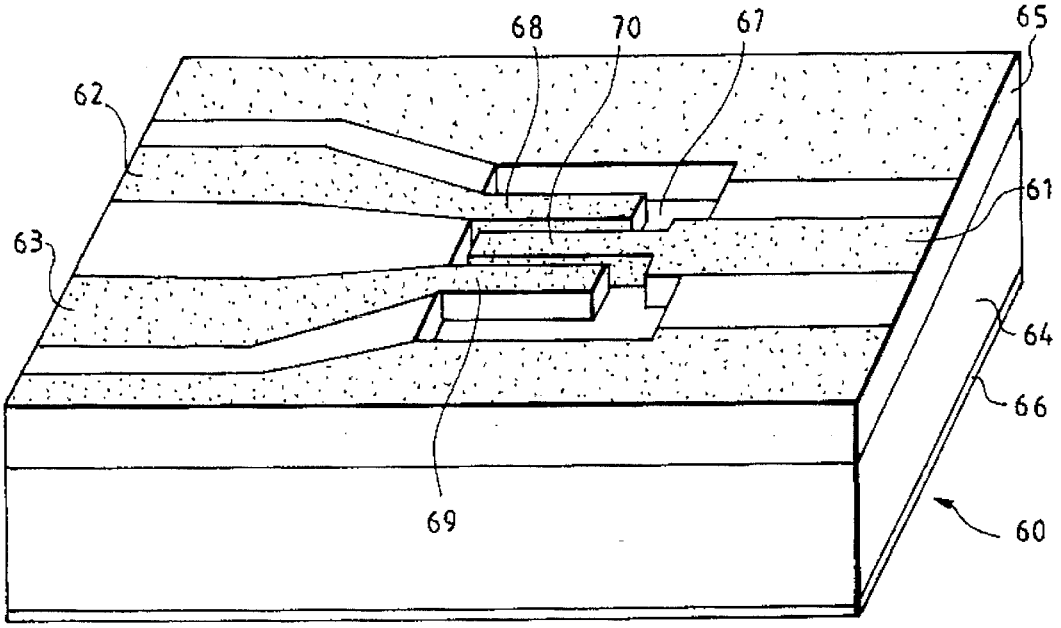
FIG. 6 is a view in perspective of an inverter according to the invention.

FIG. 6 shows a microwave element 60 that enables the line 61 to be connected to one of two different paths 62, 63. These two paths may differ by their electrical length, their impedance and their coupling.

As here above, the element 60 is made on a substrate 64, on the upper face of which an insulator layer 65 is formed. Its lower face advantageously receives a metallization layer 66. In the layer 65, a parallelepiped-shaped cavity 67 is formed, while leaving therein two parallel overhanging beams 68, 69 that project longitudinally from a side face of the cavity 67 and a third overhanging beam 70 that is parallel to the foregoing two beams and that gets inserted between them, in projecting from the opposite lateral face of the cavity 67. The upper and lateral faces of the beams 68 to 70 are metallized.

The line 61 ends at the beam 70 and its metallization gets extended by that of the upper face of this beam. The lines 62, 63 end respectively at the beams 68, 69, and their metallizations are extended by those of the upper faces of these beams.

In a way that is not shown, one pole of a DC voltage source is connected to the line 61 and the other pole is connected, via an inverter, to the band 62 or the band 63. Depending on whether the inverter connects the source to the band 62 or to the band 63, the beam 70 is drawn towards either one of the beams 68, 69. This means that the line 61 is connected to the band 62 or to the band 63 and hence to one of the microwave paths that continue these bands.

Figure 7:
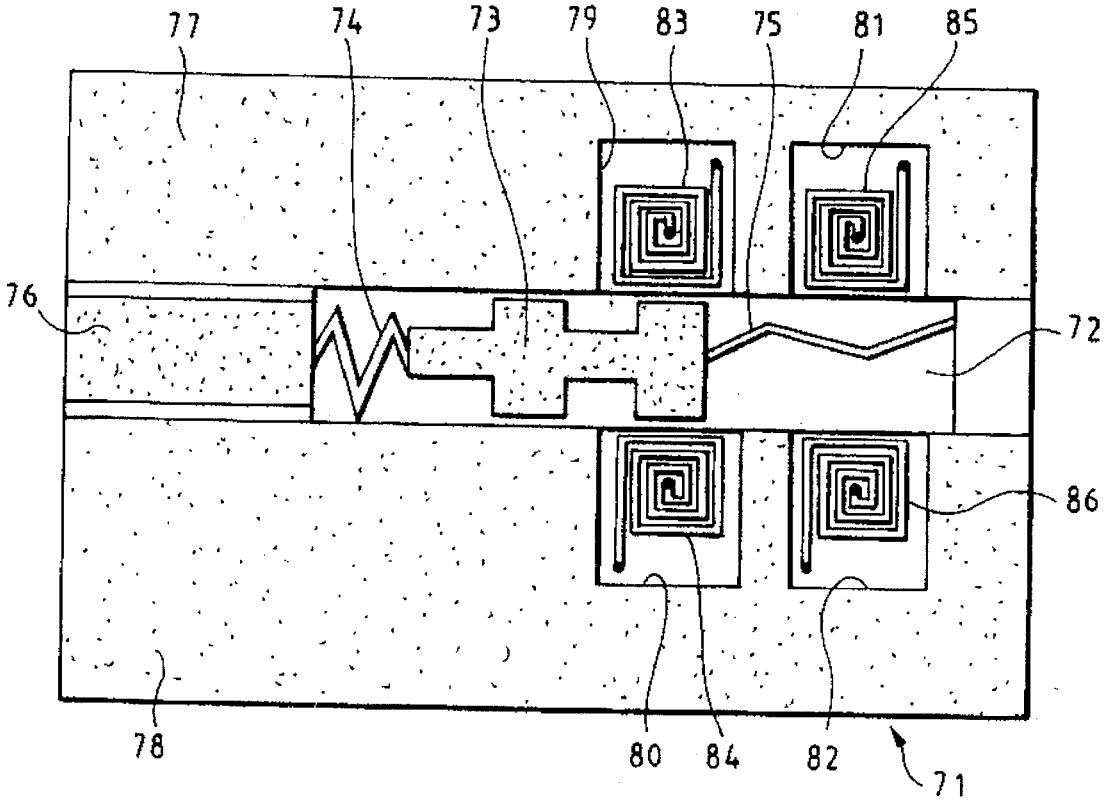
FIG. 7 is a plane view of an alternative embodiment, according to the invention, of the element of FIG. 4.

The element 71 shown in a plane view in FIG. 7 has a stub similar to that of the element 41 of FIG. 5, the essential difference lying in the fact that the movements of this stub are due no longer to an electrical field but to a magnetic field, the stub being to a major extent made of ferromagnetic material.

The element 71 is made similarly to the above-described elements placed on a substrate in the insulating layer of which a cavity 72 is formed, while leaving an element 73 in the form of two "T"s placed one on top of the other, these "T"s being connected by zigzag-shaped springs 74, 75 to opposite sides of the cavity 72. However, these springs are not absolutely necessary, for the moving element can shift freely in the cavity 72. When no springs are used, it is preferable to cover the cavity with an insulating layer that prevents the element 73 from coming out of the cavity while at the same time leaving it free to shift in the cavity. Of course, there is advantageously provided an insulator layer such as this to cover the cavity even in the presence of springs in order to protect the moving element: this observation is valid for every embodiment described herein. A cavity is then etched inside the element 73, this cavity being filled with ferromagnetic material, and the upper face of this cavity is covered with a metallization. A conductive band 76 reaches a small side of the cavity 72. This band 76 is bordered by two other conductive bands 77, 78 that extend along the large sides of the cavity 72 and are used as a ground. Rectangular slots facing each other, referenced 79, 80 and 81, 82 respectively, are made in the bands 77, 78 on the edge of the cavity 72. In these slots, there are formed inductors, referenced 83, 84, 85, 86 respectively, insulated from the bands 77 and 78. The ends of these inductors are connected, in a manner not shown, to conductors formed in layers that are deposited subsequently. As in the case of the device of FIG. 5, instead of making slots 79 to 82 in order to house the inductors 83 to 86 therein, it is possible to cover the bands 77, 78 with an insulator layer and form the inductors on this insulator layer. The element 73 is drawn to that pair of facing inductors (83,84 or 85, 86) which is supplied with power: the result of this is that the impedance coupled to the end of the line 76 is made to vary.

According to one embodiment (not shown), the lateral faces of the beams are covered with longitudinal parallel bands of metals having different coefficients of thermal expansion, supplied by a current source in order to cause the beams to bend by the "bimetallic strip" effect of these metal bands.

Naturally, when the shifting of the moving element of the invention is not limited by a fixed element against which it gets applied in order to make contact, it is possible to make it occupy either two different positions (a resting position and a "working" position that is electrically controlled) or more than two different positions, each position beyond the second position being determined by additional electrodes (such as the one of FIG. 5) or by additional inductors (such as those of FIG. 7).

In the embodiments described here above, a microcavity was mentioned each time but it is clear that this term covers any shape having at least one recess with respect to a plane surface, the four lateral faces being not necessarily present in the final component.

What is claimed is:

1. An electronic element disposed on a substrate and having a plurality of conductive and insulative layers, comprising:

at least one microcavity disposed in said layers in which there shifts, with a limited clearance or range of play, at least one moving elements defined by a portion of one of said layers, said moving element comprising an electrically conductive material or an insulator material that is at least partially covered with electrically conductive material, and interconnected with at least one microwave circuit of the substrate, and an electrical device operatively coupled to said moving element for the actuation of the moving element.

2. An element according to claim 1, wherein the electrical device for the actuation of the moving element comprises at least one pair of metallized surfaces connected to a DC voltage source.

3. An element according to claim 1, wherein the electrical device for the actuation of the moving element comprises at least one inductor disposed on the substrate, the moving element comprising a ferromagnetic material.

4. An element according to claim 1, wherein the electrical device for the actuation of the moving element comprises at least one band of metallic material that is disposed on a flexible element and works by bimetallic strip effect.

5. An element according to claim 1, wherein the moving element is an overhanging flexible beam.

6. An electronic element disposed on a substrate and having a plurality of conductive and insulative layers, comprising:

at least one microcavity disposed in said layers in which there shifts, with a limited clearance or range of play, at least one moving element, said moving element being defined by a portion of an electrically conductive material or an insulator material that is at least partially covered with electrically conductive material and interconnected with at least one microwave circuit of the substrate, and an electrical device operatively coupled to said moving element for the actuation of the moving element, wherein the moving element is a flexible beam held at opposing ends thereof.

7. An electronic element disposed on a substrate and having a plurality of conductive and insulative layers, comprising:

at least one microcavity disposed in said layers in which there shifts, with a limited clearance or range of play, at least one moving element, said moving element comprising an electrically conductive material or an insulator material that is at least partially covered with electrically conductive material, and interconnected with at least one microwave circuit of the substrate, and an electrical device operatively coupled to said moving element for the actuation of the moving element;

wherein the moving element is a rigid pad that moves freely in the microcavity.

8. A microwave circuit disposed on a substrate having several insulating and conductive layers, wherein one of the insulating layers has metallizations defining microwave circuits, at least one cavity is disposed in one of the layers, comprising:

at least one moving element defined by a portion of one of said layers, said moving element comprising an electrically conductive material or an insulator material that is at least partially covered with electrically conductive material disposed in said at least one cavity, and is interconnected with said microwave circuit, and an electrical device operatively coupled to said moving element for the actuation of the moving element.

9. A circuit according to claim 8, wherein the electrical device for the actuation of the moving element comprises at least one pair of metallized surfaces connected to a DC voltage source.

10. A circuit according to claim 8, wherein the electrical device for the actuation of the moving element comprises at least one inductor disposed on the substrate, the moving element comprising a ferroelectric material.

11. A circuit according to claim 8, wherein the electrical device for the actuation of the moving element comprises at least one band metallic material that is disposed on a flexible element and works by bimetallic strip effect.

12. A circuit according to claim 8, wherein the moving element is an overhanging flexible beam.

13. A circuit according to claim 8, wherein the moving element is a flexible beam held at opposing ends thereof.

14. A microwave circuit disposed on a substrate having several insulating and conductive layers, wherein one of the insulating layers has metallizations defining microwave circuits, at least one cavity is formed in one of the layers, comprising:

at least one moving element, said moving element comprising an electrically conductive material or an insulator material that is at least partially covered with electrically conductive material disposed in said at least one cavity, and is interconnected with said microwave circuit, and an electrical device operatively coupled to said moving element for the actuation of the moving element;

wherein the moving element is a rigid pad that moves freely in the microcavity.

15. An electronic element in a microwave circuit disposed on a substrate and having a plurality of conductive and insulative layers, comprising:

at least one microcavity;

at least one moving element disposed entirely within said microcavity comprised of an electrically conductive material or of an insulator material that is at least partially covered with electrically conductive material, and interconnected with said microwave circuit, and an electrical device for the actuation of the moving element.

16. An element according to claim 15, wherein the electrical device for the actuation of the moving element comprises at least one band metallic material that is disposed on a flexible element and works by bimetallic strip effect.

17. An element according to claim 15, wherein the moving element is an overhanging flexible beam.

18. An element according to claim 15, wherein the moving element is a flexible beam held at opposing ends thereof.

19. An element according to claim 15, wherein the moving element is a rigid pad that moves freely in the microcavity.

20. An element according to claim 15, wherein the moving element is defined by a portion of one of said layers.

* * * * *